US005383770A

United States Patent [19]

Hisahara

[11] Patent Number: 5,383,770

[45] Date of Patent: Jan. 24, 1995

[54] RADIAL PISTON PUMP WITH VENT IN HOLLOW PISTON

[75] Inventor: Keiji Hisahara, Atsugi, Japan

[73] Assignee: Unisia Jecs Corporation, Atsugi, Japan

[21] Appl. No.: 259,975

[22] Filed: Jun. 17, 1994

[30] Foreign Application Priority Data

Jun. 29, 1993 [JP] Japan ..... 5-035210[U]

[51] Int. Cl.[6] ..... F04B 1/04

[52] U.S. Cl. ..... 417/273; 91/491; 92/82

[58] Field of Search ..... 417/273, 312; 91/491; 92/82

[56] References Cited

U.S. PATENT DOCUMENTS

| | | | |
|---|---|---|---|
| 3,125,034 | 3/1964 | Lucien et al. | 103/174 |
| 4,363,607 | 12/1982 | Eichele et al. | 417/273 |
| 5,167,493 | 12/1992 | Kobari | 417/273 |

*Primary Examiner*—Richard A. Bertsch
*Assistant Examiner*—Alfred Basichas
*Attorney, Agent, or Firm*—Foley & Lardner

[57] ABSTRACT

A vibration and noise free pump is disclosed. The pump includes a plurality of cylinders in radial arrangement about an axis. A piston is slidably supported in each of the cylinders. Each of the pistons has a vent opening in addition to a set of inlet openings to admit escape of liquid out of its piston inner chamber into a well with the piston in the compression stroke. With the provision of the vent opening, a surge pressure in each of the pistons has been reducedsed.

7 Claims, 3 Drawing Sheets

RADIAL PISTON PUMP WITH VENT IN HOLLOW PISTON

BACKGROUND OF THE INVENTION

The present invention relates to a radial piston pump of the kind having pistons in their cylinder in radial arrangement about an axis.

With regard to the drive of the pistons, the pump of the above kind is of the positive-drive type, in which the driving shaft has an eccentric carrying a cam with which the spring loaded pistons are held in contact, so that the cam at each rotation of the driving shaft produces the reciprocating movement of the pistons in their respective cylinders.

The compression chamber of each cylinder receives liquid through the piston inner chamber. The piston inner chamber of each piston receives the liquid through inlet openings in the wall of the piston with the piston in the suction stroke. With the piston in the subsequent compression stroke, there occurs a surge pressure in each piston upon or immediately after closure of the inlet openings. This surge pressure causes vibration and noise of the pump.

An object of the present invention is to decrease the surge pressure in each piston of the pump of the above kind.

SUMMARY OF THE INVENTION

According to the present invention, there is provided a pump comprising:

- a pump body provided with a plurality of cylinders in radial arrangement about an axis;
- a piston slidably supported in each of said cylinders;
- a driving shaft adapted for rotation about said axis;
- means for reciprocating each of said pistons upon rotation of said driving shaft to provide suction and compression strokes;
- each of said pistons having a piston inner chamber and a set of inlet openings communicating with said piston inner chamber,
- said pump body defining a well adapted for connection to a source of liquid, said set of inlet openings of each of said pistons passing into said well with the piston in the suction stroke to admit fluid into the corresponding cylinder through said set of inlet openings and the piston inner chamber of the piston and passing out of said well with the piston in the subsequent compression stroke,
- each of said pistons having a vent opening, said vent opening of each of said pistons passing out of said well later than said set of inlet openings pass out of said well with the piston in the subsequent compression stroke to admit escape of liquid out of said piston inner chamber into said well through said vent opening.

DETAILED DESCRIPTION OF THE INVENTION

Figure 1:
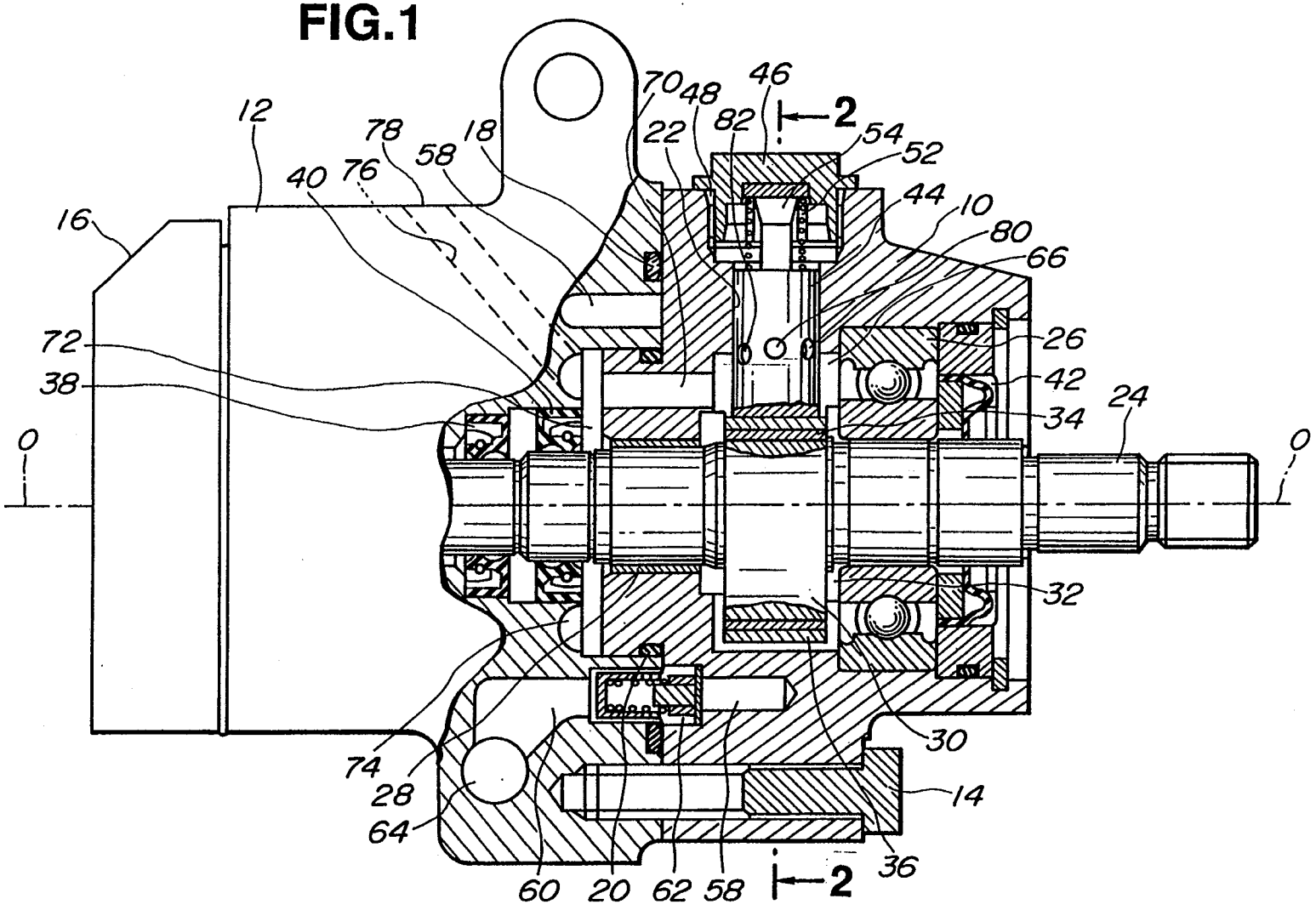
FIG. 1 shows a pump according to the present invention in partial axial cross-section through the line 1—1 of FIG. 2.
Figure 2:
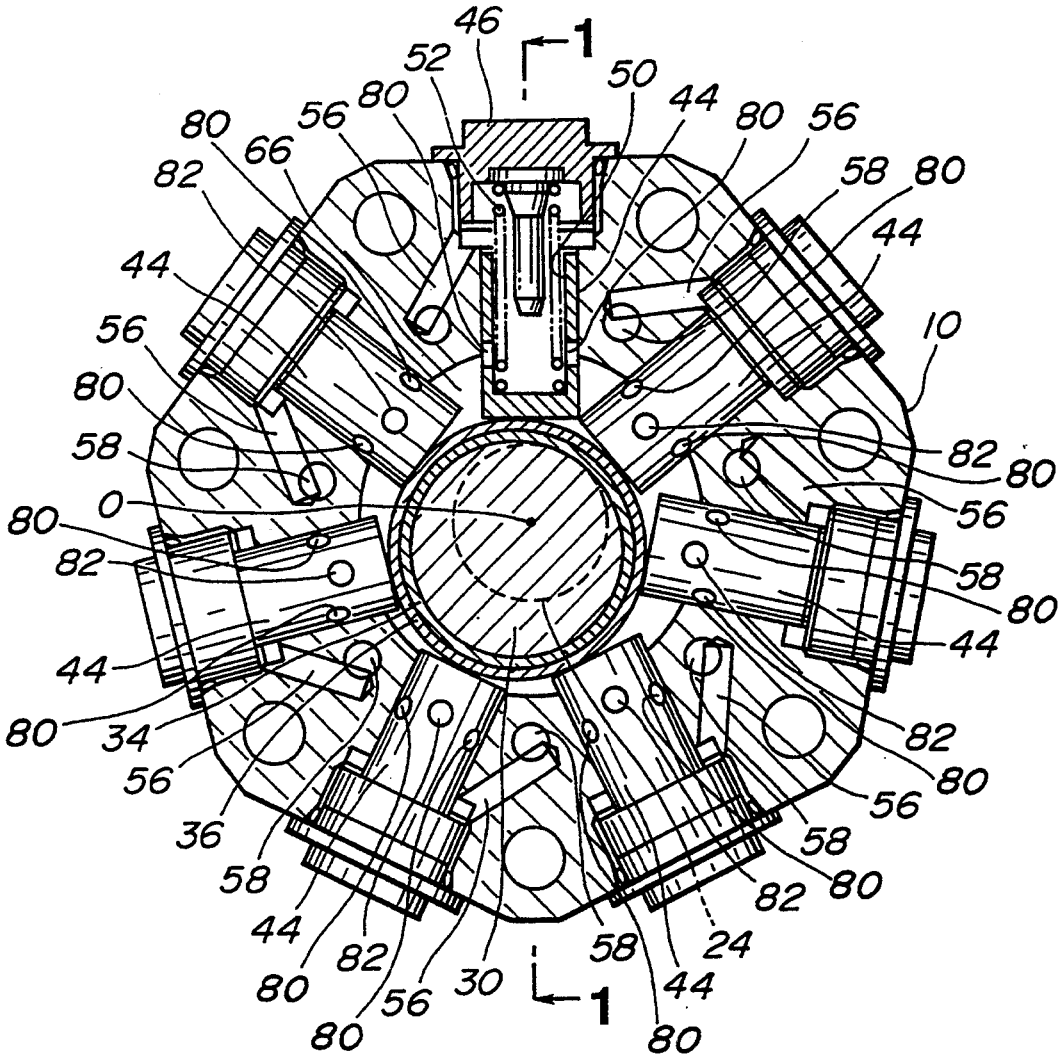
FIG. 2 is a transverse cross-section through the line 2—2 of FIG. 1.
Figure 3:
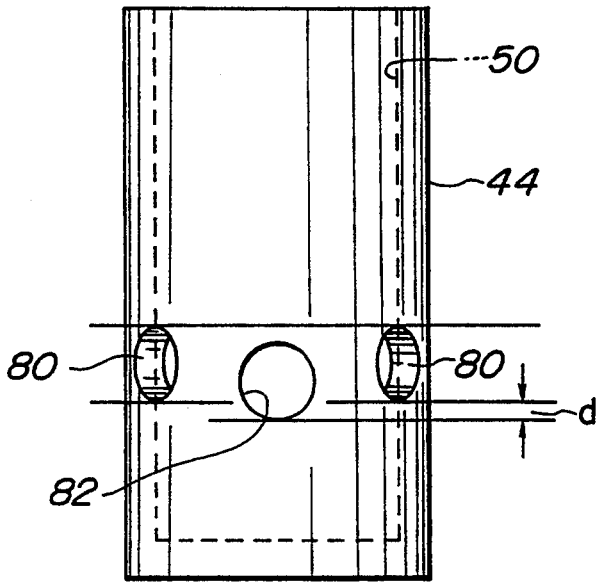
FIG. 3 is a plan view of a piston used in Fig. 1.

Referring to FIGS. 1 to 3, the pump comprises a pump body 10 closed by a center body 12 retained by screws or bolts 14. The center body 12 is closed by a cover 16. Two 0-ring sealing elements 18 and 20 are provided between the pump body 10 and the center body 12. The pump body 10 comprises radial cylinders 22, of which seven are provided in the example shown. The cylinders 22 are in radial arrangement about an axis 0. A driving shaft 24 is mounted on ball bearings 26 and on bushing 28 for rotation about the axis 0. The driving shaft 24 carries an eccentric 30. A washer 32 is provided between the eccentric 30 and an inner race of the ball bearings 26. Arranged about the eccentric 30 is a seat 34 about which a cam 36 is arranged. Sealing elements are provided at 38, 40 and 42. The cam 36 cooperates with the bottom closed ends of all pistons 44 for the positive drive of the pistons upon rotation of the driving shaft 24. The pistons 44 are slidably supported in the cylinders 22. Each cylinder 22 is closed by a plug 46 with an 0-ring sealing element 48. The pistons 44 are provided with a piston inner chamber in the form of an axial bore 50 having its radially inner end closed by the bottom closed end of the piston and its radially outer end opening to the corresponding cylinder. The pistons 44 are held in contact with the cam 36 by compression springs 52 supported via spring retainers 54 by the plugs 46.

The compression chamber of each of the cylinders 22 is in communication through a lateral passage 56 and an axial passage 58 with a circular delivery chamber 60. Each of the axial passages 58 is provided with one-way check valve 62. The delivery chamber 60 communicates with an outlet 64 of the liquid under pressure.

The pump body 10 defines a well 66 about the concentric 30. The well 66 is in fluid communication, through an axial passage 70 and a space 72 about the driving shaft 24, with a circular supply chamber 74. The supply chamber 74 is supplied with liquid through a passage 76 from an inlet 78 which is adapted for connection to a source of liquid.

Each of the pistons 22 has a set of inlet openings 80 and at least one vent opening 82, which openings 80 and 82 are formed in the cylindrical wall thereof. The inlet openings 80 are arranged such that they pass into the well 66 concurrrently with the piston in the suction stroke to admit liquid into the piston inner chamber 50 and pass out of the well 66 concurrently with the piston in the subsequent compression stroke.

The vent opening 82 of each piston passes into the well 66 with the piston in the suction stroke to admit liquid into the piston inner chamber 50 and passes out of the well 66 later than its associated inlet openings 80 do with the piston in the subsequent compression stroke to admit escape of liquid out of the piston inner chamber 50 into the well 66 through the vent opening 82.

According to the illustrated embodiment, as shown in FIG. 3, the vent opening 82 and inlet openings 80 are circular openings with the same diameter. The vent opening 82 is displaced from the inlet openings 80 by a distance d in the direction of the suction stroke or toward the bottom closed end of the piston.

Figure 4:
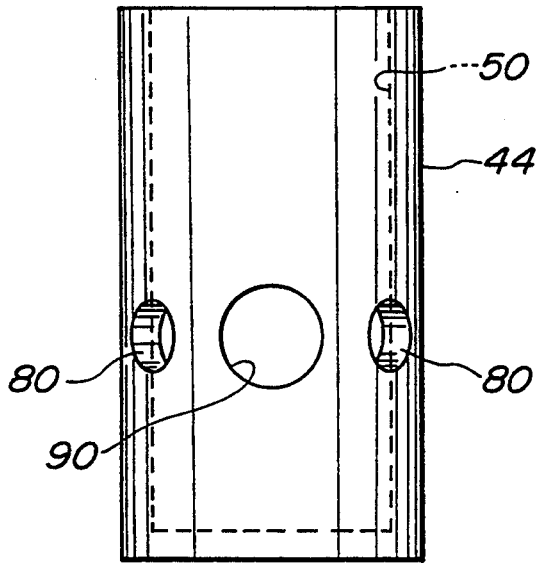
FIG. 4 is a plan view of a piston having a different form of construction.

Alternatively, as shown in FIG. 4, a vent opening 90 may have its center disposed in the transverse plane in which the centers of inlet openings 80. In this case, the vent opening 90 is enlarged to have a diameter larger than the diameter of the inlet openings 80.

The operation of the pump is as follows:

As a result of the positive drive of the pistons 44, each of the pistons carries out a to-and-fro movement at each revolution of the driving shaft 24. During the course of this movement, the inlet openings 80 of the piston inner chambers 50 of the pistons 44 are alternatively opened (suction time or phase) and closed (compression time or phase), while the vent openings 82 or 90 of the piston inner chambers 50 of the pistons 44 are alternatively opened and closed with their close timing delayed with respect to the close timing of their mating inlet openings 80. During the compression time in each of the cylinders 22, the one-way check valve 62 lifts and opens the axial passage 58 so that the delivery chamber 60 is supplied with liquid under pressure successively by all the axial passages 58.

At the initiation of compression time in each of the cylinders 22, a portion of liquid is allowed to escape from the piston inner chamber 50 into the well 66 through the vent opening 82 or 90 so that there is 3O a drop in surge pressure. Owing to the drop in surge pressure in each of the pistons 44, vibration and noise during operation of the pump are reduced to satisfactory levels.

What is claimed is:

1. A pump comprising:

a pump body provided with a plurality of cylinders in radial arrangement about an axis;

a piston slidably supported in each of said cylinders;

a driving shaft adapted for rotation about said axis;

means for reciprocating each of said pistons upon rotation of said driving shaft to provide suction and compression strokes;

each of said pistons having a piston inner chamber and a set of inlet openings communicating with said piston inner chamber, said pump body defining a well adapted for connection to a source of liquid, said set of inlet openings of each of said pistons passing into said well with the piston in the suction stroke to admit fluid into the corresponding cylinder through said set of inlet openings and the piston inner chamber of the piston and passing out of said well with the piston in the subsequent compression stroke, each of said pistons having a vent opening, said vent opening of each of said pistons passing out of said well later than said set of inlet openings pass out of said well with the piston in the subsequent compression stroke to admit escape of liquid out of said piston inner chamber into said well through said vent opening.

2. A pump as claimed in claim 1, wherein said pistons have piston inner chambers supplied with liquid from said well through said sets of inlet openings and vent openings with said pistons in their suction strokes.

3. A pump as claimed in claim 2, wherein said piston inner chamber of each of said pistons displaces a portion of liquid therein into said well through said vent opening with said piston in its compression stroke.

4. A pump as claimed in claim 1, wherein said set of inlet openings of each of said pistons are arranged such that they pass into said well concurrently with said piston in its suction stroke to admit liquid into said piston inner chamber and pass out of said well concurrently with said piston it its subsequent compression stroke.

5. A pump as claimed in claim 4, wherein said vent opening of each of said pistons passes out of said well later than its associated inlet openings do with said piston in its compression stroke to admit escape of liquid out of said piston chamber into said well through said vent opening.

6. A pump as claimed in claim 5, wherein said vent opening and inlet openings of each of said pistons are circular openings with the same diameter and said vent opening is displaced from the associated inlet openings by a predetermined distance in the direction of the suction stroke.

7. A pump as claimed in claim 5, wherein said vent opening of each of said pistons has its center disposed in the transverse plane in which the centers of the associated inlet openings lie and has a diameter larger than the diameter of said inlet openings.

* * * * *